United States Patent [19]

Masuda et al.

[11] Patent Number: 4,477,515

[45] Date of Patent: Oct. 16, 1984

[54] WADDING MATERIALS

[75] Inventors: Yugoro Masuda, Takatsuki; Shigeru Kawase, Nara, both of Japan

[73] Assignee: Kanebo, Ltd., Tokyo, Japan

[21] Appl. No.: 437,765

[22] Filed: Oct. 27, 1982

[30] Foreign Application Priority Data

| | | | |
|---|---|---|---|
| Oct. 29, 1981 | [JP] | Japan | 56-174049 |
| Oct. 31, 1981 | [JP] | Japan | 56-174793 |
| Nov. 6, 1981 | [JP] | Japan | 56-178538 |
| Mar. 17, 1982 | [JP] | Japan | 57-43384 |
| Mar. 17, 1982 | [JP] | Japan | 57-43385 |

[51] Int. Cl.[3] ..... D04H 1/58

[52] U.S. Cl. ..... 428/288; 428/294; 428/296; 428/359; 428/360; 428/361; 428/362

[58] Field of Search ..... 428/359, 361, 362, 357, 428/375, 394, 395, 288, 292, 293, 372, 296

[56] References Cited

U.S. PATENT DOCUMENTS

| | | | |
|---|---|---|---|
| 3,188,790 | 6/1965 | Hebeler . | |
| 3,952,126 | 4/1976 | Dycks | 428/372 |
| 4,105,033 | 8/1978 | Chatterjee et al. | 428/372 X |
| 4,129,675 | 12/1978 | Scott | 428/288 |
| 4,281,042 | 7/1981 | Pamm | 428/361 |
| 4,304,817 | 12/1981 | Frankosky | 428/361 |

FOREIGN PATENT DOCUMENTS

| | | |
|---|---|---|
| 633064 | 5/1964 | Japan . |
| 3074575 | 10/1975 | Japan . |
| 3913476 | 10/1976 | Japan . |
| 445678 | 3/1978 | Japan . |

*Primary Examiner*—Lorraine T. Kendell

*Attorney, Agent, or Firm*—Flynn, Thiel, Boutell & Tanis

[57] ABSTRACT

Wadding materials consist of a blend of 90–10% by weight of staple fibers (A) having a monofilament fineness of 3–10 deniers and a curliness of not less than 15% and 10–90% by weight of staple fibers (B) of a synthetic polymer having a monofilament fineness of 0.7–4 deniers, which is smaller than that of the staple fibers (A), and a curliness of less than 15%, and synthetic fibers having a melting point which is lower than that of both the above described staple fibers (A) and (B) by more than 20° C., or film-shaped structural elements (C), or of the above described blend of (A) and (B) and both the above described lower melting point synthetic fibers and the film-shaped structural elements (C). The wadding materials have natural down-like physical properties, such as high compressibility, compactness, high bulkiness, moderate resiliency, high drape property, good body fitness, soft touch, light weight and excellent warmth retaining ability.

36 Claims, No Drawings

WADDING MATERIALS

BACKGROUND OF THE INVENTION

1. Field of the Invention

The present invention relates to wading materials.

2. Description of the Prior Art

Heretofore, natural downs have been the most preferable waddings of winter clothes and coverlets. Downs have been conventionally used because of various excellent properties but the yield amount is very limited, so that downs are very expensive. Therefore, it has been recently attempted to artificially produce downs. For example, it has been attempted to incorporate polyester staple fibers in natural down or to treat polyester fibers with silicone resin but these attempts have not been satisfactory and materials having a variety of excellent properties possessed by natural downs have not been yet developed. These artificial materials, after using or laundering, lose resiliency, entangle or cause cutting and gather together to one side in a cover cloth and can not maintain even dispersion. They have no high compressibility allowing them to be laid away compactly, no original bulkiness, and no bulk recovery in reuse, that is, these materials can not recover the original state owing to a low mechanical force (so called beat back property). These materials have great practical defects.

As filling materials to be used for coverlets, such as bed quilts, winter clothes and the like, substantially hollow globular bodies have been disclosed in Japanese Patent Application Publication No. 4,456/78, but these bodies are difficult to compress, the feeling is rough and rigid and it is difficult to obtain so called "down-like physical properties".

On the other hand, Japanese Patent Application Publication No. 30,745/75 has proposed globular bodies having a diameter of about 5–40 mm formed by using a high fineness of about 10–300 deniers as a cushion material but compression is also difficult because of the high fineness of the used fibers and the feeling becomes rough and rigid.

Japanese Patent Application Publication No. 39,134/76 has proposed globular bodies formed of fibrous masses of nylon, polyester, polyacrylonitrile, polyvinyl, and polyvinylidene chloride, but this can not avoid the same defects as described above and is not satisfactory.

Regarding bed quilt wadding, Japanese Patent Application Publication No. 6,330/64 has described a mixture of natural or artificial fibers for bed quilt wadding with ribbon-shaped cut cellophane, but the wadding readily gathers together to one side in a cover cloth and when the wadding gathers together, the recovering ability is low, the resiliency is low and the wadding can not be used as down-like materials. In particular, when laundering, the wadding is apt to gather together to one side and the resiliency is lost, various properties are greatly varied and such a wadding is used with difficulty for clothes, such as down jackets, etc.

SUMMARY OF THE INVENTION

The inventors have made diligent studies for obviating these prior drawbacks and have accomplished the present invention.

An object of the present invention is to provide wadding materials which hardly gather together to one side in a cover cloth and easily recover the original form even when gathered together to one side, have high resiliency, and do not vary in various properties even after laundering.

A further object is to provide wadding materials having high compressibility which have compactness, high bulkiness, moderate resiliency, high drape property, good body fitness, soft touch, light weight and excellent warmth retaining ability.

Another object is to provide wadding materials which can be folded into a compact form upon folding and laying away, are small in storing space, are excellent in bulkiness recovery when reusing and can recover the original properties.

The other objects are clarified by the following explanation.

The present invention lies in the following subject matter, that is:

(1) Wadding materials consisting of 100 parts by weight of a blend of 90–10% by weight of staple fibers (A) having a monofilament fineness of 3–10 deniers and a curliness of not less than 15% and 10–90% by weight of staple fibers (B) of a synthetic polymer having a monofilament fineness of 0.7–4 deniers, which is smaller than that of the staple fibers (A), and a curliness of less than 15%, and a maximum of 100 parts by weight, based on 100 parts by weight of the blend, of synthetic fibers having a melting point which is lower than that of both the above described staple fibers (A) and (B) by more than 20° C.;

(2) Wadding materials consisting of 100 parts by weight of a blend of 90–10% by weight of staple fibers (A) having a monofilament fineness of 3–10 deniers and a curliness of not less than 15% and 10–90% by weight of staple fibers (B) of a synthetic polymer having a monofilament fineness of 0.7–4 deniers, which is smaller than that of the staple fibers (A), and a curliness of less than 15%, and 1–50 parts by weight of film-shaped structural element (C); and (3) Wadding materials consisting of 100 parts by weight of a mixture of a blend of 90–10% by weight of staple fibers (A) having a monofilament fineness of 3–10 deniers and a curliness of not less than 15% and 10–90% by weight of staple fibers (B) of a synthetic polymer having a monofilament fineness of 0.7–4 deniers, which is smaller than that of the staple fibers (A), and a curliness of less than 15%, with film-shaped structural element (C), and a maximum of 100 parts by weight of synthetic fibers having a melting point which is lower than both the above described blend and the film-shaped structural element (C) by more than 20° C.

DESCRIPTION OF THE PREFERRED EMBODIMENTS

The staple fibers (A) to be used in the present invention include various fibers of polyesters, polypropylenes, polyethylenes, polyamides, wool and the like and in particular, polyester fibers readily obtain various effects mentioned hereinafter and are preferable for obtaining the wadding materials of the present invention. As the fiber length of the staple fibers (A), 20–120 mm is usually used, 20–100 mm is preferable and 20–80 mm is more preferable. It is not necessary for the fiber length to be uniform, and fibers having different lengths may be blended. If the fineness and curliness of the staple fibers (A) are within the moderate range under the state where the staple fibers (B) are blended, the original bulkiness is high, the compressibility is high, the compression stress and the instant repellency are low, the formed fibrous articles are readily folded and laid away in a compact form, the touch is soft and the body fitness is good. However, when the fineness is too great, the compressibility becomes low, the compression stress and the repellency are too large and it is difficult to fold and lay away the formed fibrous articles in a small space. When the fineness and curliness are too small, the bulkiness is poor, the compression stress becomes too small and the resiliency is lost. Based on these results, the monofilament fineness of the staple fibers (A) is 3–10 deniers, preferably 4–7 deniers and the curliness is not less than 15%, preferably not less than 18%. The upper limit of the curliness is about 30% in view of the production of crimped fibers.

"Curliness" used herein is expressed by the following formula $$(B-A)/B\times 100(\%)$$

A: The fiber length when a load of 2 mg/denier is applied.

B: The fiber length when a load of 50 mg/denier is applied.

A large number of fibers are sampled from the fibrous assembly of the produced fibrous blend, the measurement is effected with respect to this sample and an average value is determined.

The staple fibers (B) to be used in the present invention include various synthetic fibers of synthetic polymers of polyesters, polypropylenes, polyethylenes, polyamides, etc. and among them, polyester fibers can easily provide the effects of the present invention and these fibers are preferable. The fiber length of the staple fibers (B) is about 20–200 mm, preferably 20–150 mm, more preferably 20–120 mm. In this case, bias-cut fibers may be used. The relation of the various effects to the fineness and fiber length of the staple fibers (B) is substantially the same as in the staple fibers (A), but in order to develop the maximum effect in the fibrous assembly wherein the staple fibers (B) are blended with the above described staple fibers (A), the fineness of the staple fibers (B) must be smaller than that of the staple fibers (A) and is within a range of 0.7–4 deniers, preferably 1–3 deniers. The curliness of the staple fibers (B) is less than 15%, preferably less than 10%. Only when the staple fibers having such a small curliness, which are not usually used, including curliness of 0, that is having no crimps, are used, can the effect of the present invention be obtained to the maximum limit, and when the fibrous articles stored compactly are reused, if the articles are beaten or shaken slightly and a mechanical stimulation or vibration is given, the bulkiness is recovered (referred to as "beat back property" hereinafter).

The staple fibers (A) and (B) may be not only the fibers consisting of one component alone but also include composite fibers wherein different polymers, the same kind of polymers having different viscosity and the like are conjugate spun in concentric, eccentric or side-by-side relation. In addition, the staple fibers (A) and (B) include hollow fibers and porous fibers. If composite hollow fibers are used as the staple fibers (A), crimps can be easily obtained and are fast, and such fibers are light and bulky and are high in the warmth retaining ability, so that such fibers are particularly preferable. In this case, the hollow percentage is generally about 5–30%.

In the present invention, it is essential that the specifically defined staple fibers (A) and (B) as described above are blended, and in the specifically defined blend range, the compressibility is high, the instant elastic recovery and the compression stress are moderate, laying away is easy, moderate resiliency is obtained, and the use feeling, touch feeling and drape property are excellent. For the purpose, 90–10% by weight, preferably 80–20% by weight, more preferably 70–30% by weight of the staple fibers (A) and 10–90% by weight, preferably 20–80% by weight, more preferably 30–70% by weight of the staple fibers (B) are blended. Beyond the above described blend range, the above described excellent effects can not be obtained.

Staple fibers other than the staple fibers (A) and the staple fibers (B), for example fibers composed of different materials or having different fineness or curliness, may be mixed in an amount of less than about 30% by weight based on the total fibers. As these staple fibers, mention may be made of synthetic fibers of polyamides, polyesters, polypropylenes and natural fibers, such as wool etc.

The term "synthetic fibers having a low melting point" used in the present invention means ones having at least one component having a melting point which is lower than that of the staple fibers (A) and (B) and the film-shaped structural element (C), when said element (C) is used, by more than 20° C., preferably more than 30° C. That is, the synthetic fibers having the low melting point include composite fibers wherein a polymer having the low melting point and a polymer which is different from or the same as the above described low melting point polymer and has a melting point which is higher than the above described temperature difference, are conjugate spun in a side-by-side, concentric or eccentric relation other than the fibers composed of the above described component having the low melting point alone.

As the above described components having the low melting point, polymers such as polyesters, polyamides, polyacrylonitriles, polyethylenes and the like, and a variety of modified polymers or copolycondensates are used.

When the fineness of the synthetic fibers having the low melting point is low, the bonding density becomes high when heat melt-bonding is effected and if said fineness is high, the bonding strength becomes high when heat melt-bonding is effected, so that the fineness of 1–15 deniers, preferably 1.5–10 deniers. On the other hand, the fiber length is usually 2–200 mm, preferably 5–100 mm.

The synthetic fibers having the low melting point to be used in the present invention are mixed in an amount of a maximum of 100 parts by weight, preferably 2–50 parts by weight, more preferably 3–40 parts by weight, most preferably 4–30 parts by weight based on 100 parts by weight of the blend of the above described staple fibers (A) and (B) or the mixture of said blend with the film-shaped structural element (C).

When the mixed amount of the synthetic fibers having the low melting point exceeds 100 parts by weight, the wadding material becomes rough and rigid and further the other physical properties, such as bulkiness, are deteriorated.

The film-shaped structural element (C) according to the present invention is made of thin flaky substances composed of synthetic polymers. As the polymers, mention may be made of polyesters, polypropylenes, polyethylenes, polyamides, polyvinyl chlorides, polyvinyl alcohols and the like. Polyesters are excellent in physical properties and others and are particularly preferable. The term "flaky substances" used herein means ones of which the thickness is thin as compared with the longitudinal and transversal length and the thickness can be properly selected in order to give the best properties to the wadding materials of the present invention but is about 5–200 μm, preferably about 10–80 μm.

The plane form of the film-shaped structural element is optionally rectangular, tree branch-form and the like, but the rectangle is simple and relatively high in the effect and is preferable. The size may be optionally selected to a certain degree for obtaining the highest effect but if explanation is made with respect to the rectangular form as an embodiment, the longitudinal length is 1–20 cm, preferably 1.5–15 cm, more preferably 2–10 cm and the transversal length is 0.01–1 cm, preferably 0.01–0.8 cm, more preferably 0.02–0.5 cm. If this is expressed by an area, that is a developed area, said area is 0.01–20 $cm^2$, preferably 0.02–10 $cm^2$ and more preferably 0.03–5 $cm^2$. These flaky substances are preferred to be generally more than 10, particularly more than 15 in the ratio of the longitudinal length to the transversal length. So called "flat thread" is used in this thin flaky substance. These substances may be properly curved or crimped and three-dimensionally deformed. Furthermore, the substances wherein the above described shape and size are common or different may be blended in two or more kinds in any ratio.

The film-shaped structural elements (C) to be used in the present invention can be obtained, for example, by cutting a bi-axially drawn polyester film in a proper width and length. In the present invention, other than such a film, films vacuum-evaporated with a metal may be used. In such films, ones having infrared reflection coefficient of more that 50% are preferable. These substances include structures wherein a reflecting material is vacuum-evaporated, coated or plated on a film surface, structures wherein a reflecting material is contained in the inner portion through kneading or structures wherein a reflecting material is put between two film supporters. Particularly, the structures in which aluminum is vacuum-evaporated are high in the infrared reflection coefficient and therefore are preferable. Of course, it is possible to use a mixture of a vacuum-evaporated structural element with a non-vacuum-evaporated structural element.

The film-shaped structural element (C) to be used in the present invention is preferably mixed with the blend of the staple fibers (A) and the staple fibers (B) in an amount of 1–50 parts by weight, preferably 2–30 parts by weight, more preferably 3–25 parts by weight, particularly 4–20 parts by weight based on 100 parts by weight of the total amount of said blend. When the amount of the film-shaped structural element (C) is less than 1 part by weight, the bulkiness and the beat back property are low and the resiliency may be not satisfactory. When said amount exceeds 50 parts by weight, the bulkiness and the beat back property are deteriorated and the body fitness is degraded.

The wadding materials according to the present invention wherein the fibers as materials are mixed with film-shaped structural elements and/or synthetic fibers having a low melting point may be mixed through usual processes. Furthermore, the film-shaped structural elements and the synthetic fibers having the low melting point may be subjected to carding together with the above described fibrous materials depending upon the size and if necessary, the mixing may be effected after carding step of the above described fibrous materials.

The mixed wadding materials may be used not only in a web form but also in a random fibrous mass, for example by disturbing the arrangement of the web into fibrous masses of about 1–10 cm through a mechanical force, wind force or manual force and if necessary, the separated fibrous masses are rounded. These fibrous masses are preferably round bodies having a diameter of 10–50 mm and a substantially uniform density of less than 0.03 $g/cm^3$, in which the staple fibers (A) and (B) and if necessary, film-shaped structural element (C) and other elements are entangled with one another. The term "the fibers are entangled with one another" used herein means that when a single filament is observed, said filament is mutually crossed or entangled with one or a plurality of other filaments around said single filament and does not mean that the filaments are merely superposed as in the case where a filament is wound on a bobbin. The term "round bodies having the substantially uniform density" used herein includes fibrous masses which are not only of a globular shape or a similar shape thereto, but also of an elongated or flat shape, and in short, it is merely necessary that said bodies are different from the prior continuous wadding layer and are independent fibrous masses. When the density of the fibers in the surface portion, the middle portion and the central portion is observed, the fibers in the surface portion are not present in a dense state, and the fibers are present in a substantially uniform density as a whole. The diameter is preferably 10–50 mm and more preferably 20–40 mm. The density is preferably less than 0.03 $g/cm^3$, more preferably less than 0.02 $g/cm^3$. When the diameter is too small, the bulkiness is reduced, and reversely when the diameter is too large, gaps are formed in the portions where the fibrous masses are contacted, the warmth retaining ability lowers, and such a diameter is not preferable. If the density is too high, the bulkiness is poor, the compression becomes difficult, and the touch is rigid, and such a density is not preferable.

These round bodies may be formed by a variety of processes and explanation will be made hereinafter with respect to one embodiment. Firstly, the materials to form the wadding materials, such as the staple fibers (A) and (B) and the like, are properly mixed and then thoroughly opened and mixed through an opening machine, such as a flat card, a roller card, a random webber and the like, to form webs. The thus formed webs are cut or drawn into fibrous masses having a necessary size through mechanical, wind or manual force to separate the fibers and further, if necessary, the separated fibers are wrinkled by mechanical, wind or manual force to round the fibrous masses.

When the mixed wadding materials contain the synthetic fibers having a low melting point, the synthetic fibers having a low melting point are softened and melted by heating to bond and fix the fibrous materials. In this case, the heating temperature is set so that said temperature is lower than the melting point of any of the fibrous materials and the film-shaped structural element and is higher than the melting point of the synthetic fibers having a low melting point. The heating time varies according to the composition and denier of the low melting point component and the setting temperature and the like but the conditions can be previously determined by test and the time is no greater than 10 minutes. When the wadding materials are used as a fibrous mass, the wadding materials may be heated to cause the melt-bonding in the web form and then separated into fibrous masses. If necessary, the wadding materials of the present invention may be treated with a lubricating agent, such as spin finishes, a silicone compound and a fluorine compound to make the static friction coefficient between fibers less than 0.45, preferably less than 0.20.

Said treatment may be carried out before mixing the fibrous components composing the wadding materials with respect to a part or the whole of said components or after mixing the fibrous components with respect to the web form or fibrous masses, or with respect to the heat melt-bonded wadding materials. In this case, an elastic polymer, a softening agent and the like may be used together.

For the above described treatment, in the present invention, it is effective to use a mixture of polyorganosilicon compound with polyurethane. As the polyorganosilicon compounds, mention may be made of compounds having siloxane bonds in the main chain, for example dimenthylpolysiloxane, methylphenylpolysiloxane, methylhydrodienepolysiloxane and various modified compounds, such as polyether modified, epoxy modified, alcohol modified, amino modified and alkyl modified compounds. Polyorganosilicon compounds generally used as a softening agent or a lubricating agent may be used alone or in admixture of two or more compounds, and if necessary together with a catalyst. Film-forming silicones and reactive silicones are high in durability and are preferable.

As the above described polyurethanes, mention may be made of ester type, ether type or ester-ether type, for example in the case of emulsion type, emulsified and dispersed ones are included and in the case of water soluble types, ones wherein a hydrophilic group, such as ethyleneoxide, sodium sulfonate, quaternary ammonium etc. is introduced, are included but if the polyurethanes are ones generally used, they may be used alone or in admixture of two or more. Thermal reactive type water soluble polyurethane in which an isocyanate group is blocked with a proper blocking agent can easily obtain various effects mentioned hereafter, is high in durability and water resistance and is preferable.

The weight ratio of a mixture of polyurethane and polyorganosilicon compound is preferred to be 1:1–1:0.01, particularly 1:0.5–1:0.02, more particularly 1:0.3–1:0.03.

When said silicone compounds are beyond the above described range, slimy feeling becomes too high and the resiliency improving effect is insufficient. Conversely, if the amount of the polyurethane is too much, the feeling becomes rigid and this is not preferable.

In the present invention, the mixture of polyorganosilicon compound and polyurethane is preferably used in an amount of 0.2–20% by weight, preferably 0.5–15% by weight, particularly 1–10% by weight in solid content based on the weight of the mixture of the above described fibrous materials and the film-shaped structural element or the synthetic fibers having a low melting point.

There are various processes for applying these agents but explanation will be made with respect to one embodiment hereinafter. The above described fibrous web or fibrous mass is dipped in a mixed solution having a proper concentration of a water soluble or emulsion type polyorganosilicon compound and a water soluble or emulsion type polyurethane and then the solution is removed, or said fibrous web or mass is sprayed with the above described mixed solution, whereby the mixed solution is applied on the fibrous web or the fibrous mass and dried and if necessary, cured. The drying and curing conditions vary depending upon the used processing agent, the amount of the above described mixed solution applied and the like and can be predetermined by experiments but the drying is generally not greater than 10 minutes at a temperature of 100°–140° C. and the curing is not greater than 10 minutes at a temperature of 130°–180° C. In this case, it is necessary that the temperature is lower than the melting point of the above described fibers and film-shaped structural elements (C) but in the case where the synthetic fibers having a low melting point are mixed, the above described drying or curing may be effected at the same time as when the melt-bonding is effected.

The wadding materials of the present invention may be used for coverlets such as futon (Japanese mattress), clothes providing protection against the cold and warmth retaining ability by being covered with a proper cloth, various industrial materials needing heat insulation and the like. In this case, the wadding materials of the present invention may be used in a single layer or plural layers and in the case of use in the plural layers, the wadding materials may be used as one or both of the upper and lower faces or as an intermediate layer. The wadding materials of the present invention may be used by mixing said materials with other fibers of less than 30% based on the total amount. As these fibers, mention may be made of synthetic, semisynthetic and natural fibers, such as polyesters, polyamides, polypropylenes, kapok, and films cut in small pieces, such as polyesters, polyamides, polypropylene, etc.

The first effect of the wadding materials of the present invention is the excellent body fitness and laundering resistance. Prior general wadding materials lose the resiliency and cause cutting owing to wearing and laundering, and gather to one side in a cover cloth. Natural down has the same problem and is difficult in that laundering at home and is apt to cause the gathering to one side. However, the gathering of down to one side returns to the original state by light beating. The wadding materials of the present invention scarcely lose the resiliency even by water washing and even if the wadding materials gather to one side in a cover cloth, the materials easily return to the original state as with down.

The second effect of the wadding materials of the present invention is achievement of down-like physical properties, and firstly the original bulkiness is high. In general, when the same weight of sampling is effected, the highest bulkiness is natural down. The bulkiness of the usual wadding materials is about half as high as natural downs and even the better one is about 70% of natural downs. Nevertheless, the wadding materials according to the present invention have the equal or higher bulkiness as compared with natural downs.

Furthermore, the wadding materials of the present invention can provide the same high compressibility as natural downs. Even though natural downs are high in bulkiness, the load necessary for the compression is low and natural downs can be compressed to a very small volume, so that when the downs are laid away, the necessary space is advantageously small. On the other hand, the compression stress of usual prior wadding materials can be made equal to or less than that of downs but in this case, the bulkiness is usually deteriorated and further when the compression stress is too small, the resiliency becomes low and this is not preferable. Thus, prior usual wadding materials can not concurrently satisfy the bulkiness and compressibility and the moderate resiliency. The wadding materials of the present invention are substantially equal in the compression stress to downs, so that said materials can be laid away in compactness and further said materials have moderate resiliency upon using, have high bulkiness as mentioned above and thus both of the above described properties are obtained.

The third effect is the high bulk recovery. After laying away in compactness as mentioned above, upon reuse, the bulkiness should be satisfactorily recovered. When prior wadding materials have been laid away in a compact form for a long time, said materials gradually strain and the recovering ability is lost, so that prior wadding materials are poor in the bulk recovery. Downs have very high bulk recovery as well as high original bulkiness. In particular, the recovery (beat back property) when applying a mechanical force, for example beating by hand, is excellent. The wadding materials of the present invention have excellent bulk recovery including the beat back property, which has never been possessed by prior wadding materials. In the coverlets and clothes which are poor in the drape property and do not fit to the body, air warmed with body heat escapes from spaces, but the wadding materials of the present invention are high in body fitness and the warmed air does not escape, and the bulkiness is always maintained upon using as described above so that the warmth retaining ability is good. In particular, the wadding materials wherein films vacuum-evaporated with a metal, such as aluminum, are mixed therein are excellent in the warmth retaining ability. In addition, natural downs are not too hard or soft and have moderate soft touch. The wadding materials of the present invention also have similarly excellent body touch and have the same or more excellent properties as natural down in all points.

Natural downs and usual wadding materials penetrate to the outside through the cover cloth, so that in order to prevent this blowing out, a woven fabric having a high density and down-proof base cloth applied with a resin coating are used as a cover cloth, but down-proofing is expensive and it is difficult to completely prevent the blowing out. The wadding materials of the present invention do not cause such blowing out. Furthermore, said materials do not have too slimy a feeling or rough feeling, but have moderate tacky feeling and are preferable. When lightly touched, said materials are soft and have good touch.

Furthermore, the wadding materials of the present invention have a variety of excellent properties as mentioned above but are simple in structure, so that said materials can be produced very cheaply and economically and the commercial value is very high.

The following examples are given for the purpose of illustration of this invention and are not intended as limitations thereof. "Part" in the following examples means by weight. The following properties were determined as follows.

4 g of the wadding material was packed in a cover cloth made by sewing the periphery of two superposed square cloths having a side of 12 cm to prepare a sample to be tested.

A sample was compressed to 5 mm by means of an Instron apparatus and left to stand under the compressed state for 5 minutes, and then the weight was removed. The sample was then left to stand under the unloaded state for 5 minutes and then again compressed.

Original bulkiness: Thickness (mm) when a first load (1.3 g/cm$^2$) was applied to the sample in the course of the above described first compression.

Compression stress: Stress (g/cm$^2$) immediately after compressed to 5 mm in the first compression course.

Initial compression hardness: Stress (g/cm$^2$) when compressing the sample 20 mm from the thickness when the above described first load (1.3 g/cm$^2$) was applied in the first compression course.

A high load of 70 g/cm$^2$ was applied to the sample for 24 hours and then the load was removed, and the sample was left to stand for 5 minutes to permit the sample to naturally recover the bulkiness. Then, the thus treated sample was rotated for 5 minutes with a tumbler drier to give vibration and thereafter the first load (1.3 g/cm$^2$) was applied to the sample to determine the thickness (total recovered bulkiness, mm).

$$\text{Beat back recovery percentage} = \frac{\text{Total recovered bulkiness}}{\text{Original bulkiness}} \times 100.$$

Beat back property after laundering:

A square cushion having a side of 50 cm was prepared and quilted so as to be equally divided into three portions. This cushion was laundered for 10 minutes with a tumbler type washing machine and rinsed for 3 minutes repeatedly three times and then subjected to centrifugal dehydration and dried. The recovery when the wadding materials gathered to one side were beated with hand was judged visually and tactilely to evaluate the results into four classes of "excellent", "good", "acceptable" and "unacceptable".

Warmth retaining ability was expressed by warmth retaining percentage (%) measured by using a sample having a weight of 400 g/cm$^2$ following JIS-L-1079A.

Static friction coefficient between fibers was determined by Röder method.

Various measured evaluations other than the above described properties were made by the following processes.

Feeling:

Five experts for evaluating the feeling held and slided the sample in which the wadding material was packed in a cover cloth between fingers to judge the slimy feeling. Moderate sliminess is defined as "o", a sample which has no sliminess, is rough and is not suitable for the wadding material is defined as "x" and the intermediate feeling is defined as "Δ".

Softness:

Five experts for evaluating the feeling judged the softness when they lightly pressed the sample in which the wadding material is packed in a cover cloth. The softness which is preferable for the wadding material is defined as "o", the hard and undesirable one is defined to as "x" and the intermediate one is defined as "Δ".

Penetration number:

After the samples obtained by packing the wadding materials in cover cloths were rubbed with each other 100 times, the number of fibers blown out from 100 cm$^2$ of the cover cloth was determined.

EXAMPLE 1

60 parts of staple fibers (A) having a hollow percentage of 16.1%, a fineness of 6 deniers, a curliness of 22.0% and a fiber length of 60 mm and composed of composite hollow fibers obtained by conjugate spinning polyethylene terephthalate having a relative viscosity ($\eta$rel) of 1.37 and polyethylene terephthalate having a relative viscosity of 1.22 in a side-by-side relation in a ratio of 1:1 and 40 parts of polyester staple fibers (B) having a fineness of 1.3 deniers, a curliness of 7.7% and a fiber length of 45 mm were mixed with synthetic fibers having a low melting point (3 deniers, 50 mm) composed of polyester having a melting point of 110° C. as shown in the following Table 1. The resulting mixtures were subjected to carding and the carded fibers were rounded into fibrous masses having a diameter of about 3 cm. The obtained fibrous masses were heated at 160° C. for 3 minutes to effect the melt-bonding. The thus formed wadding materials were packed in nylon cover cloths and subjected to a variety of measurements. The obtained results are shown in Table 1. The above described fibers were used after being treated with a lubricating agent. The density of any wadding materials was about 0.014 g/cm$^3$.

TABLE 1

| Experiment No. | Mixed amount of low melting point fibers (part) | Original bulkiness (mm) | Initial compression hardness (g/cm$^2$) | Compression stress (g/cm$^2$) |
|---|---|---|---|---|
| 1-1 (Present invention) | 1 | 50.8 | 10.5 | 58.3 |
| 1-2 (Present invention) | 5 | 50.3 | 10.9 | 61.6 |
| 1-3 (Present invention) | 10 | 49.7 | 11.1 | 65.2 |
| 1-4 (Present invention) | 20 | 48.5 | 11.5 | 70.3 |
| 1-5 (Present invention) | 30 | 47.3 | 11.8 | 75.5 |
| 1-6 (Present invention) | 40 | 46.5 | 12.1 | 79.7 |
| 1-7 (Present invention) | 50 | 45.8 | 12.4 | 83.4 |
| 1-8 (Present invention) | 100 | 43.0 | 13.7 | 97.0 |
| 1-9 (Comparative example) | 150 | 40.6 | 14.9 | 109.1 |

From the above results, it can be seen that if the mixed amount of the low melting point fibers is within the specifically defined range, the beat back property after laundering is excellent and the original bulkiness, the compressibility and the feeding are good.

EXAMPLE 2

A blend of polyester staple fibers (A) having a fineness of 5 deniers, a curliness of 19.1% and a fiber length of 67 mm and polyester staple fibers (B) having a fineness of 1.5 deniers, a curliness of 9.4% and a fiber length of 50 mm in the mixed ratio shown in the following Table 2, and 25 parts of low melting point composite synthetic fibers (5 deniers, 60 mm) consisting of polyester having a lower melting point of 120° C. and polyester having a higher melting point of 248° C. were subjected to carding and then formed into round fibrous masses having a diameter of about 2 cm. These masses were heated at 160° C. for 3 minutes to obtain melt-bonded wadding materials, which were packed in nylon cover cloth. A variety of measurements were made with respect to these samples and the obtained results are shown in Table 2. The above described fibrous masses were treated with a lubricating agent after the melt-bonding. The density of any fibrous masses was about 0.005 g/cm$^3$.

TABLE 2

| Experiment No. | Amount of staple fibers (A) (part) | Amount of staple fibers (B) (part) | Original bulkiness (mm) | Initial compression hardness (g/cm$^2$) | Compression stress (g/cm$^2$) |
|---|---|---|---|---|---|
| 2-1 (Comparative example) | 100 | 0 | 57.6 | 15.2 | 105.3 |
| 2-2 (Present invention) | 90 | 10 | 56.3 | 14.3 | 97.5 |
| 2-3 (Present invention) | 80 | 20 | 55.1 | 13.7 | 91.0 |
| 2-4 (Present invention) | 60 | 40 | 52.6 | 11.9 | 76.3 |
| 2-5 (Present invention) | 40 | 60 | 49.2 | 10.4 | 68.6 |
| 2-6 (Present invention) | 20 | 80 | 45.2 | 8.7 | 52.7 |
| 2-7 (Present invention) | 10 | 90 | 43.3 | 8.0 | 47.4 |
| 2-8 (Comparative example) | 0 | 100 | 41.3 | 7.1 | 40.3 |

From the above results, it can be seen that the samples wherein the staple fibers (A) and the staple fibers (B) are blended as the fibrous materials are excellent in the beat back property after laundering, the original bulkiness, the compressibility, the feeling and the like.

EXAMPLE 3

50 parts of polyester staple fibers (A) composed of the same composite hollow fibers as described in Example 1 and having a fineness of 7 deniers, a curliness of 21.4%, and a fiber length of 76 mm and 50 parts of polyester staple fibers (B) having a fineness of 1 denier, a curliness of 6.9% and a fiber length of 38 mm were mixed with 15 parts of low melting point composite synthetic fibers (3 deniers, 65 mm) consisting of polypropylene having a melting point of 170° C. as the higher melting point component and polyethylene having a melting point of 125° C. as the lower melting point component and the resulting mixtures were subjected to carding and heated at 140° C. for 5 minutes to effect the melt-bonding. The formed wadding materials were packed in cover cloths and subjected to various measurements. (The above described fibers were treated with a lubricating agent).

The original bulkiness was 51.5 mm, the initial compression hardness was 11.0 g/cm$^2$, the compression stress was 70.5 g/cm$^2$ and the beat back property after laundering was excellent and all of the beat back property, the bulkiness and the feeling were excellent.

EXAMPLE 4

100 parts of a blend obtained by mixing in the mixed ratio shown in the following Table 3 staple fibers (A) having a hollow percentage of 15.7%, a fineness of 6 deniers, a curliness of 22.6% and a fiber length of 65 mm, composed of composite hollow fibers obtained by conjugate spinning polyethylene terephthalate having a relative viscosity ($\eta$rel) of 1.37 and polyethylene terephthalate having a relative viscosity of 1.25 in a ratio of 1:1 in a side-by-side relation, and polyester staple fibers (B) having a fineness of 1.3 deniers, a curliness of 6.2% and a fiber length of 50 mm was mixed with 10 parts of polyester films vacuumevaporated with aluminum having an elongated rectangular form (width of 0.027 cm, length of 3 cm) having a developed area of 0.08 $cm^2$, which have been crimped. The resulting mixtures were subjected to carding and separated into fibrous masses and further rounded into globular fibrous masses having a diameter of about 3 cm and the thus formed wadding materials were packed in polyester cover cloths and subjected to a variety of measurements. The obtained results are shown in Table 3. The above described fibers were treated with a lubricating agent to make a friction coefficient 0.16. The density of the round wadding materials was about 0.007 $g/cm^3$.

TABLE 3

| Experiment No. | Mixed ratio of staple fibers (A)/staple fibers (B) | Original bulkiness (mm) | Initial compression hardness ($g/cm^2$) | Compression stress ($g/cm^2$) | Total recovered bulkiness (mm) |
|---|---|---|---|---|---|
| 4-1 (Comparative example) | 100/0 | 56.8 | 15.3 | 108.6 | 51.7 |
| 4-2 (Present invention) | 90/10 | 56.3 | 14.2 | 96.7 | 51.5 |
| 4-3 (Present invention) | 80/20 | 55.7 | 13.5 | 84.3 | 51.2 |
| 4-4 (Present invention) | 60/40 | 52.5 | 11.7 | 68.5 | 49.4 |
| 4-5 (Present invention) | 40/60 | 49.0 | 10.1 | 58.6 | 47.0 |
| 4-6 (Present invention) | 20/80 | 45.8 | 8.6 | 50.1 | 43.1 |
| 4-7 (Present invention) | 10/90 | 44.1 | 7.6 | 47.5 | 40.9 |
| 4-8 (Comparative example) | 0/100 | 42.0 | 6.6 | 44.1 | 38.6 |

From the above described results, it can be seen that when the mixed ratio of the staple fibers (A) and the staple fibers (B) is within the specifically defined range, the original bulkiness is high and the compression stress is moderately low (the degree is not so low that the resiliency is lost), laying away in compactly is feasible and when reusing, the beat back property is high, so that the bulk recovery is good.

The result of the initial compression hardness shows that the wadding materials of the present invention have satisfactory soft touch, high drape property and excellent body fitness.

When the warmth retaining percentage was measured with respect to the sample of Experiment No. 4-3, said percentage was 80.3%.

EXAMPLE 5

100 parts of a blend obtained by mixing polyester staple fibers (A) having a fineness of 6 deniers, a curliness of 18.2%, a fiber length of 65 mm and polyester staple fibers (B) having a fineness of 1 denier, a curliness of 8.1% and a fiber length of 48 mm in the mixed ratio shown in the following Table 4, was mixed with 5 parts of polyester films wherein elongated rectangular films (width of 0.04 cm, length of 10 cm) having a developed area of 0.4 $cm^2$ were curved in an opened L-shape. The resulting mixtures were subjected to carding and separated into fibrous masses having a diameter of about 4 cm. The thus formed wadding materials were packed in polyester-cotton mixed cover cloths and a variety of measurements were made with respect to these samples. The obtained results are shown in Table 4. The above described fibers were treated with a lubricating agent to obtain a friction coefficient of 0.18. The density of the fibrous masses was about 0.008 $g/cm^3$.

TABLE 4

| Experiment No. | Mixed ratio of staple fibers (A)/staple fibers (B) | Original bulkiness (mm) | Initial compression hardness ($g/cm^2$) | Compression stress ($g/cm^2$) | Total recovered bulkiness (mm) |
|---|---|---|---|---|---|
| 5-1 (Comparative example) | 100/0 | 55.3 | 15.1 | 105.1 | 49.8 |
| 5-2 (Present invention) | 90/10 | 54.7 | 13.9 | 92.7 | 49.7 |
| 5-3 (Present invention) | 80/20 | 54.0 | 13.2 | 81.5 | 49.6 |
| 5-4 (Present invention) | 60/40 | 50.8 | 11.4 | 65.3 | 47.2 |
| 5-5 (Present invention) | 40/60 | 48.1 | 9.7 | 56.0 | 45.7 |
| 5-6 (Present invention) | 20/80 | 44.3 | 8.4 | 47.2 | 41.2 |
| 5-7 (Present invention) | 10/90 | 42.7 | 7.5 | 44.8 | 39.5 |
| 5-8 (Comparative example) | 0/100 | 41.0 | 6.4 | 42.1 | 37.3 |

From the above described results, it can be seen that when the mixed ratio of the staple fibers (A) and the staple fibers (B) is within the specifically defined range, the original bulkiness is high and the compression stress is moderately low (the degree is not so low that the resiliency is lost), laying away compactly is feasible and when reusing, the beat back property is high, so that the bulk recovery is good.

The result of the initial compression hardness shows that the wadding materials of the present invention have satisfactory soft touch, high drape property and excellent body fit.

When the warmth retaining percentage was measured with respect to the sample of Experiment No. 5-4, said percentage was 78.5% and high.

EXAMPLE 6

50 parts of staple fibers (A) composed of the same composite hollow fibers as described in Example 4 and having a fineness of 5 deniers, a curliness of 23.5% and a fiber length of 50 mm and 50 parts of polyester staple fibers (B) having a fineness of 1 denier, a curliness of 5.2% and a fiber length of 38 mm were mixed with polyester films vacuum-evaporated with aluminum having an elongated rectangular form (width of 0.027 cm, length of 5 cm) having a developed area of 0.135 $cm^2$, which had been crimped, in the mixed ratios shown in the following Table 5. The resulting mixtures were subjected to carding and separated into fibrous masses having a diameter of about 3 cm and the thus formed wadding materials were packed in nylon cover cloths and subjected to a variety of measurements. The obtained results are shown in Table 5. The above described fibers were treated with a lubricating agent to make the friction coefficient 0.17. The density of the wadding materials was about 0.016 g/cm$^3$.

TABLE 5

| Experiment No. | Mixed amount of film (part) | Original bulkiness (mm) | Initial compression hardness (g/cm$^2$) | Compression stress (g/cm$^2$) | Total recovered bulkiness (mm) |
|---|---|---|---|---|---|
| 6-1 (Comparative example) | 0 | 45.2 | 12.4 | 42.4 | 40.4 |
| 6-2 (Present invention) | 2 | 46.9 | 12.1 | 50.1 | 42.2 |
| 6-3 (Present invention) | 3 | 48.0 | 11.8 | 55.3 | 43.7 |
| 6-4 (Present invention) | 5 | 49.8 | 11.3 | 62.8 | 45.8 |
| 6-5 (Present invention) | 10 | 50.7 | 10.9 | 62.3 | 47.7 |
| 6-6 (Present invention) | 20 | 48.7 | 11.1 | 58.7 | 45.8 |
| 6-7 (Present invention) | 30 | 47.4 | 11.4 | 54.2 | 45.0 |
| 6-8 (Present invention) | 40 | 46.3 | 11.6 | 49.7 | 43.9 |
| 6-9 (Present invention) | 50 | 45.7 | 11.9 | 45.8 | 43.8 |
| 6-10 (Comparative example) | 100 | 40.1 | 13.1 | 32.4 | 39.0 |

The above described results show that if the mixed ratio of the polyester film vacuum-evaporated with aluminum is within the specifically defined range, the original bulkiness is high, the compression stress is moderate, the resiliency is high, the compression is easy and the beat back property is excellent.

EXAMPLE 7

50 parts of staple fibers (A) composed of the same composite hollow fibers as described in Example 4 and having a fineness of 5 deniers, a curliness of 22.8% and a fiber length of 50 mm and 50 parts of polyester staple fibers (B) having a fineness of 1 denier, a curliness of 6.3% and a fiber length of 50 mm were mixed with polyester films vacuum-evaporated with aluminum having an elongated rectangular form (width of 0.04 cm, length of 3 cm) having a developed area of 0.12 cm$^2$, which had been crimped in the mixed ratios shown in the following Table 6. The resulting mixtures were subjected to carding, separated into fibrous masses and rounded into globular wadding materials having a diameter of about 2 cm and the thus formed wadding materials were packed in polyester cover cloths and subjected to a variety of measurements. The obtained results are shown in Table 6. The above described fibers having 5 deniers were treated with a lubricating agent to make the friction coefficient 0.19. The density of the wadding materials was about 0.017 g/cm$^3$.

TABLE 6

| Experiment No. | Mixed amount of film (part) | Original bulkiness (mm) | Initial compression hardness (g/cm$^2$) | Compression stress (g/cm$^2$) | Total recovered bulkiness (mm) |
|---|---|---|---|---|---|
| 7-1 (Comparative example) | 0 | 44.8 | 12.2 | 41.7 | 39.4 |
| 7-2 (Present invention) | 2 | 46.1 | 12.0 | 49.6 | 41.5 |
| 7-3 (Present invention) | 3 | 47.5 | 11.6 | 54.7 | 42.8 |
| 7-4 (Present invention) | 5 | 49.0 | 11.0 | 61.5 | 44.6 |
| 7-5 (Present invention) | 10 | 50.1 | 10.7 | 61.7 | 46.6 |
| 7-6 (Present invention) | 20 | 48.2 | 10.9 | 57.9 | 45.3 |
| 7-7 (Present invention) | 30 | 46.8 | 11.2 | 53.4 | 44.0 |
| 7-8 (Present invention) | 40 | 45.4 | 11.4 | 49.0 | 43.1 |
| 7-9 (Present invention) | 50 | 44.1 | 11.7 | 44.9 | 42.3 |
| 7-10 (Comparative example) | 100 | 39.5 | 12.9 | 31.7 | 38.4 |

The above described results show that if the mixed ratio of the polyester film vacuum-evaporated with aluminum is within the specifically defined range, the original bulkiness is high, the compression stress is moderate, the resiliency is high, the compression is easy and the beat back property is excellent.

EXAMPLE 8

100 parts of blends obtained by mixing polyester staple fibers (A) and (B) having the fineness and curliness as shown in the following Table 7 in various mixed ratios was mixed with 10 parts of polyester films vacuum-evaporated with aluminum and having an elongated rectangular form (width of 0.04 cm, length of 3 cm) of a developed area of 0.12 cm$^2$ and the resulting mixtures were subjected to carding. The thus obtained wadding materials were packed in polyester-cotton mixed cloths respectively and a variety of measurements were made with respect to these samples. The above described fibers were treated with a lubricating agent to make the friction coefficient 0.18.

TABLE 7

| Experiment No. | Amount of staple fibers (A) | | | Amount of staple fibers (B) | | | Original bulkiness (mm) | Initial compression hardness (g/cm$^2$) | Compression stress (g/cm$^2$) |
|---|---|---|---|---|---|---|---|---|---|
| | Fineness (denier) | Curliness (%) | Mixed amount (part) | Fineness (denier) | Curliness (%) | Mixed amount (part) | | | |
| 8-1 (Present invention) | 6 | 21.8 | 70 | 1.5 | 4.7 | 30 | 53.8 | 12.3 | 76.3 |
| 8-2 (Present invention) | 5 | 20.4 | 30 | 2 | 6.7 | 70 | 47.5 | 8.1 | 55.0 |
| 8-3 (Comparative example) | 2 | 17.3 | 40 | 1.5 | 5.1 | 60 | 41.3 | 6.9 | 44.1 |
| 8-4 (Comparative example) | 13 | 20.8 | 60 | 1.5 | 4.8 | 40 | 58.3 | 15.6 | 119.9 |
| 8-5 (Comparative example) | 4 | 21.1 | 20 | 0.5 | 5.4 | 80 | 40.3 | 6.6 | 43.4 |

TABLE 7-continued

| Experiment No. | Amount of staple fibers (A) Fineness (denier) | Curliness (%) | Mixed amount (part) | Amount of staple fibers (B) Fineness (denier) | Curliness (%) | Mixed amount (part) | Original bulkiness (mm) | Initial compression hardness (g/cm²) | Compression stress (g/cm²) |
|---|---|---|---|---|---|---|---|---|---|
| 8-6 (Comparative example) | 6 | 22.5 | 50 | 5 | 8.2 | 50 | 57.5 | 14.7 | 115.2 |
| 8-7 (Comparative example) | 3.5 | 8.5 | 20 | 1 | 7.8 | 80 | 40.7 | 7.0 | 46.5 |
| 8-8 (Comparative example) | 10 | 21.3 | 70 | 2.5 | 18.2 | 30 | 54.5 | 14.6 | 110.0 |

From the above described results, it can be seen that if the fineness and the curliness of the staple fibers (A) and the staple fibers (B) are within the specifically defined ranges, the original bulkiness and the compressibility are satisfactory and the moderate resiliency and the soft feelings are obtained.

EXAMPLE 9

100 parts of a mixture obtained by mixing 50 parts of staple fibers (A) having a hollow percentage of 16.5%, a fineness of 5 deniers, a curliness of 22.3% and a fiber length of 65 mm, composed of composite hollow fibers obtained by conjugate spinning polyethylene terephthalate having a relative viscosity ($\eta$ rel) of 1.38 and polyethylene terephthalate having a relative viscosity of 1.21 in a ratio of 1:1 in a side-by-side relation, 50 parts of polyester staple fibers (B) having a fineness of 1.5 deniers, a curliness of 7.0% and a fiber length of 38 mm and 10 parts of polyester films vacuum-evaporated with aluminum and having an elongated rectangular form width of 0.04 cm, length of 3 cm) having a developed area of 0.12 cm², which had been crimped, was mixed with synthetic fibers having a low melting point, a fineness of 5 deniers and a fiber length of 38 mm, which were composed of polyester having a melting point of 120° C., in the mixed ratio shown in the following Table 8. The formed mixtures were subjected to carding and separated into fibrous masses having a diameter of about 3 cm, and then these fibrous masses were heated at 160° C. for 5 minutes to effect melt-bonding. The thus formed wadding materials were packed in polyester cover cloths and subjected to a variety of measurements and the obtained results are shown in Table 8. The above described fibers were treated with a lubricating agent to make the friction coefficient 0.18. The density of the wadding materials was about 0.015 g/cm³.

TABLE 8

| Experiment No. | Mixed amount of low melting point fibers (part) | Original bulkiness (mm) | Initial compression hardness (g/cm²) | Compression stress (g/cm²) | Beat back property after laundering |
|---|---|---|---|---|---|
| 9-1 (Present invention) | 1 | 51.2 | 10.7 | 60.7 | Acceptable~unacceptable |
| 9-2 (Present invention) | 5 | 50.6 | 11.0 | 63.6 | Acceptable |
| 9-3 (Present invention) | 10 | 50.0 | 11.3 | 67.1 | Good |
| 9-4 (Present invention) | 20 | 48.7 | 11.8 | 72.8 | Excellent |
| 9-5 (Present invention) | 30 | 47.6 | 12.1 | 77.9 | Excellent |
| 9-6 (Present invention) | 40 | 46.8 | 12.5 | 82.1 | Excellent |
| 9-7 (Present invention) | 50 | 46.1 | 12.8 | 85.7 | Excellent |
| 9-8 (Present invention) | 100 | 43.2 | 13.9 | 99.3 | Excellent |
| 9-9 (Comparative example) | 150 | 40.8 | 15.0 | 111.7 | Excellent |

From the above described results, it can be seen that if the mixed amount of the low melting point fibers is within the specifically defined range, the beat back property after laundering is excellent and the original bulkiness, compressibility and feeling are good.

The warmth retaining percentage was measured with respect to the sample Experiment No. 9-4 and said percentage was 79.0%.

EXAMPLE 10

Polyester staple fibers (A) having a fineness of 4 deniers, a curliness of 18.3% and a fiber length of 65 mm and polyester staple fibers (B) having a fineness of 1.5 deniers, a curliness of 8.3% and a fiber length of 48 mm were mixed in the mixed ratio as shown in the following Table 9, and 5 parts of polyester films vacuum-evaporated with aluminum having an elongated rectangular form (width of 0.02 cm, length of 2.5 cm) having a developed area of 0.05 cm² were mixed therewith. 100 parts of the thus formed mixtures were mixed with 20 parts of low melting point composite synthetic filaments (3 deniers, 64 mm) composed of polyethylene having a melting point of 125° C. as the lower melting point component and polypropylene having a melting point of 170° C. as the higher melting point component and the mixtures were subjected to carding and forming into fibrous masses having a diameter of about 2 cm. The fibrous masses were heated at 150° C. for 3 minutes to effect the melt-bonding. The formed wadding material was packed in nylon cover cloths and subjected to various measurements. The above described fibers were treated with a lubricating agent. The density of the fibrous masses was about 0.01 g/cm³.

TABLE 9

| Experiment No. | Amount of staple fibers (A) (part) | Amount of staple fibers (B) (part) | Original bulkiness (mm) | Initial compression hardness (g/cm²) | Compression stress (g/cm²) | Beat back property after laundering |
|---|---|---|---|---|---|---|
| 10-1 (Present invention) | 80 | 20 | 54.5 | 13.8 | 89.3 | Excellent |
| 10-2 (Present invention) | 60 | 40 | 51.4 | 11.7 | 72.8 | Excellent |
| 10-3 (Present invention) | 40 | 60 | 48.0 | 10.3 | 60.7 | Excellent |

TABLE 9-continued

| Experiment No. | Amount of staple fibers (A) (part) | Amount of staple fibers (B) (part) | Original bulkiness (mm) | Initial compression hardness ($g/cm^2$) | Compression stress ($g/cm^2$) | Beat back property after laundering |
|---|---|---|---|---|---|---|
| 10-4 (Present invention) | 20 | 80 | 44.9 | 8.7 | 51.4 | Excellent |

From the above described results, it can be seen that the samples wherein the staple fibers (A) and the staple fibers (B) are mixed are excellent in the beat back property, the original bulkiness, the compressibility and the feeling.

EXAMPLE 11

30 parts of polyester staple fibers (A) composed of the same composite hollow fibers as described in Example 9 and having a fineness of 4 deniers, a curliness of 22.1% and a fiber length of 65 mm and 70 parts of polyester staple fibers (B) having a fineness of 1.3 denier, a curliness of 4.7% and a fiber length of 38 mm were mixed with polyester films having an elongated rectangular form (width of 0.1 cm, length of 5 cm) having a developed area of 0.5 $cm^2$, which had been curved in an opened L-shape, in the mixed ratios as shown in the following Table 10. 100 parts of the thus formed mixtures were mixed with 15 parts of low melting point composite fibers (6 deniers, 51 mm) consisting of polyester having a melting point of 245° C. as a higher melting point component and polyester having a melting point of 110° C. as a lower melting point component, and the resulting mixtures were subjected to carding and heated at 170° C. for 3 minutes to obtain melt-bonded wadding materials. The thus formed wadding materials were packed in polyester-cotton mixed cloths and subjected to a variety of measurements and the obtained results are shown in Table 10. The above described fibers were treated with a lubricating agent to make the friction coefficient 0.17.

TABLE 10

| Experiment No. | Mixed amount of film (part) | Original bulkiness (mm) | Compression stress ($g/cm^2$) | Beat back property after laundering |
|---|---|---|---|---|
| 11-1 (Present invention) | 2 | 44.3 | 50.6 | Excellent |
| 11-2 (Present invention) | 3 | 45.3 | 54.8 | Excellent |
| 11-3 (Present invention) | 5 | 45.9 | 61.9 | Excellent |
| 11-4 (Present invention) | 10 | 47.7 | 61.5 | Excellent |
| 11-5 (Present invention) | 20 | 45.9 | 58.3 | Excellent |
| 11-6 (Present invention) | 30 | 44.7 | 53.8 | Excellent |
| 11-7 (Present invention) | 40 | 43.6 | 49.2 | Excellent |
| 11-8 (Present invention) | 50 | 43.1 | 45.3 | Excellent |

From the above described results, it can be seen that the samples wherein the polyester films are mixed are excellent in the beat back property after laundering, the bulkiness and the compressibility.

The warmth retaining percentage was measured with respect to the sample of Experiment No. 11-4and said percentage was 77.6%.

EXAMPLE 12

50 parts of polyester staple fibers (A) having a fiber length of 68 mm, a curliness of about 20–22% as shown in the following Table 11 and a fineness as shown in Table 11 and 50 parts of polyester staple fibers (B) having a fineness of 1.5 deniers, a fiber length of 40 mm and a curliness of 7.5% and 20 parts of low melting point synthetic fibers composed of polyester having a melting point of 130° C. and having a fineness of 4 deniers and a fiber length of 50 mm were mixed to form card webs and the card webs were separated and formed into round masses. These masses were heated at 150° C. for 2 minutes to obtain wadding materials having a diameter of 35 mm and a density of 0.013 $g/cm^3$. The wadding materials were packed in cover cloths and subjected to a variety of measurements and the obtained results are shown in Table 11. The staple fibers (A) were treated with a silicone lubricating agent.

TABLE 11

| Experiment No. | Staple fibers (A) Fineness (denier) | Staple fibers (A) Curliness (%) | Original bulkiness (mm) | Compression stress ($g/cm^2$) |
|---|---|---|---|---|
| 12-1 (Comparative example) | 2 | 20.3 | 41.8 | 41.0 |
| 12-2 (Present invention) | 4 | 22.3 | 46.9 | 56.7 |
| 12-3 (Present invention) | 7 | 21.8 | 52.3 | 73.8 |
| 12-4 (Comparative example) | 12 | 22.0 | 56.1 | 120.5 |

In the samples in which the wadding materials are packed, the deformation and the penetration were scarcely caused and the resiliency was maintained.

From the results of Table 11, it can be seen that when the fineness of the staple fibers (A) is within the specifically defined range, the original bulkiness is satisfied, the compression stress is moderate, the wadding material can be laid away compactly and the resiliency is not lost in reuse.

EXAMPLE 13

This example was effected in the same manner as described in Example 12 except that, in place of the staple fibers used in Example 12, polyester hollow composite fibers having a fineness of 6 deniers and a curliness shown in the following Table 12 were used, and the obtained results are shown in Table 12. Both the fibers were treated with a silicone lubricating agent.

TABLE 12

| Experiment No. | Curliness of staple fibers (A) (%) | Original bulkiness (mm) | Compression stress ($g/cm^2$) |
|---|---|---|---|
| 13-1 (Comparative example) | 11.8 | 42.5 | 42.7 |
| 13-2 (Present invention) | 18.3 | 46.1 | 61.4 |
| 13-3 (Present invention) | 22.5 | 50.8 | 72.3 |
| 13-4 (Present invention) | 27.0 | 53.7 | 86.9 |

In the samples in which the wadding materials are packed, the deformation and the penetration were scarcely caused and the resiliency was maintained.

From the above described results, it can be seen that when the curliness of the staple fibers (A) is more than about 15%, the original bulkiness is excellent, the compression stress is moderate, the wadding material can be laid away compactly and the resiliency is not lost.

EXAMPLE 14

Polyester staple fibers (A) having a fineness of 6 deniers, a fiber length of 65 mm and a curliness of 22.0% and polyester staple fibers (B) having a fineness of 1.3 deniers, a fiber length of 40 mm and a curliness of 6.1% were mixed in a mixed ratio shown in the following Table 13. 100 parts of the blend of the staple fibers (A) and (B) was mixed with 10 parts of low melting point synthetic fibers composed of composite fibers consisting of polyester having a melting point of 140° C. as a lower melting point component and polyester having a melting point of 248° C. as a higher melting point component, and having a fineness of 5 deniers and a fiber length of 60 mm to form card webs. The card webs were separated and formed into globular forms and heated at 170° C. for 1 minute to obtain globular wadding materials having a diameter of 30 mm and a density of 0.007 g/cm$^3$. Various properties were evaluated with respect to the samples and the obtained results are shown in Table 13. Both the fibers were treated with a silicone lubricating agent.

TABLE 13

| Experiment No. | Mixed ratio of staple fibers (A)/ staple fibers (B) | Original bulkiness (mm) | Compression stress (g/cm$^2$) |
|---|---|---|---|
| 14-1 (Comparative example) | 100/0 | 57.9 | 104.6 |
| 14-2 (Present invention) | 90/10 | 56.5 | 96.2 |
| 14-3 (Present invention) | 70/30 | 53.8 | 83.0 |
| 14-4 (Present invention) | 50/50 | 51.0 | 71.8 |
| 14-5 (Present invention) | 30/70 | 49.8 | 60.1 |
| 14-6 (Present invention) | 10/90 | 43.5 | 46.8 |
| 14-7 (Comparative example) | 0/100 | 41.2 | 40.1 |

The wadding materials scarcely caused the deformation and penetration and the resiliency was not lost.

From the above described results, it can be seen that when the mixed ratio of the staple fibers (A) and the staple fibers (B) is within the specifically defined range, the original bulkiness is high, the compression stress is moderate (it is not so low that the resiliency is lost) and the wadding materials can be laid away compactly.

EXAMPLE 15

65 parts of staple fibers (A) composed of polyester hollow composite fibers and having a hollow percentage of 18.5%, a fineness of 7 deniers, a curliness of 21.4%, and a fiber length of 68 mm, 35 parts of polyester staple fibers (B) having a fineness of 2 deniers, a curliness of 9.7% and a fiber length of 40 mm, 15 parts of polyester films vacuum-evaporated with aluminum and having an elongated rectangular form having a developed area of 0.12 cm$^2$, which have been crimped, and 20 parts of low melting point synthetic fibers composed of polyester having a melting point of 130° C. and having a fineness of 4 deniers and a fiber length of 50 mm were mixed and the resulting mixtures were subjected to carding and separated into globular fibrous masses. These fibrous masses were heated at 150° C. for 2 minutes to effect the melt-bonding to obtain round wadding materials having a diameter of 25 mm and a density of 0.01 g/cm$^3$.

A mixed solution of a water soluble polyurethane (hydran HW-100) and an emulsion type polyorganosilicon compound (amino modified siloxane and expoxy modified siloxane) in the mixed ratio shown in the following Table 14 was sprayed on the wadding materials so that the solid content became 2% and the sprayed wadding materials were dried at 130° C. for 3 minutes and baked at 150° C. for 2 minutes. A variety of properties were measured with respect to the formed samples and the obtained results are shown in Table 14.

TABLE 14

| Experiment No. | Urethane:Silicone | Feeling | Softness | Penetration number |
|---|---|---|---|---|
| 15-1 (Comparative example) | 1:2 | x (too slimy) | o | 15 |
| 15-2 (Present invention) | 1:1 | Δ (highly slimy) | o | 6 |
| 15-3 (Present invention) | 1:0.5 | o (moderately slimy) | o | 3 |
| 15-4 (Present invention) | 1:0.1 | o (moderately slimy) | o | 2 |
| 15-5 (Present invention) | 1:0.002 | o (moderately slimy | o | 1 |
| 15-6 (Present invention) | 1:0.01 | Δ (somewhat rough) | Δ | 1 |
| 15-7 (Comparative example) | 1:0 | x (rough) | x | 1 |

The wadding materials of the present invention were high in the bulkiness and the compression was easy and the recovery was good.

From the above described results, it can be seen that when the mixed ratio of polyurethane and polyorganosilicon compound is within the specifically defined range, the obtained products show down-like physical properties and are excellent in the feeling and softness and the penetration is low.

EXAMPLE 16

50 parts of polyester staple fibers (A) composed of hollow composite fibers having a hollow percentage of 16.9%, a fineness of 5 deniers, a curliness of 23.1%, a fiber length of 60 mm, 50 parts of polyester staple fibers (B) having a fineness of 1.5 deniers, a curliness of 8.6% and a fiber length of 48 mm and 15 parts of low melting point synthetic fibers composed of polyester composite fibers consisting of polyester having a melting point of 125° C. as a lower melting point component and polyester having a melting point of 245° C. as a higher melting point component were mixed and the resulting mixtures were subjected to carding and separated into fibrous masses and rounded and heated at 160° C. for 1 minute to effect the melting-bonding to obtain globular wadding materials having a diameter of 30 mm and a density of 0.007 g/cm$^3$. Said materials were dipped in a mixed solution of water soluble polyurethane (Elastron F-29) and polyorganosilicon compound (Dick silicone softener-A-900) in a mixed ratio of 1:0.1 so that an amount of the solid content applied became as shown in Table 15. The solution was removed by a centrifugal dehydrating machine, the drying was effected at 110° C. for 5 minutes and the curing was effected at 150° C. for 2 minutes. Measurements were made with respect to the samples and the obtained results are shown in Table 15.

TABLE 15

| Experiment No. | Applied amount | Softness | Penetration number |
|---|---|---|---|
| 16-1 (Comparative example) | 0.1 | o | 18 |
| 16-2 (Present invention) | 0.3 | o | 9 |
| 16-3 (Present invention) | 2 | o | 4 |
| 16-4 (Present invention) | 7 | o | 2 |
| 16-5 (Present invention) | 15 | o | 2 |
| 16-6 (Present invention) | 20 | Δ | 1 |
| 16-7 (Comparative example) | 30 | x | 1 |

Furthermore, the wadding materials of the present invention had high bulkiness, desired compression and high recovery.

From the above described results, it can be seen that if an amount of the mixture of polyurethane and polyorganosilicon compound applied is within the specifically defined range, the formed samples show the down-like physical properties, are soft and low in penetration.

What is claimed is:

1. A wadding material in the form of a plurality of fibrous masses of entangled fibers each having a diameter in the range of 10 to 50 mm and a density of less than 0.03 g/cm$^3$, said fibrous masses consisting essentially of a mixture of (I) 100 parts by weight of a blend of (1) 90% to 10% by weight of staple fibers (A) selected from natural and synthetic fibers suitable for use in wadding materials, said staple fibers (A) having a monofilament fineness in the range of 3 to 10 deniers and a curliness of not less than 15%, and (2) 10% to 90% by weight of staple fibers (B) made of synthetic polymer suitable for use in wadding materials having a monofilament fineness in the range of 0.7 to 4 deniers and a curliness of less than 15%, the fineness of said staple fibers (B) being less than the fineness of said staple fibers (A), in which the curliness of said staple fibers (A) and (B) is equal to $(B-A)/B\times 100\%$, wherein A is the fiber length under a load of 2 mg/denier and B is the fiber length under a load of 50 mg/denier; and (II) 2 to 100 parts by weight, per 100 parts by weight of said blend, of low-melting synthetic fibers suitable for use in wadding materials having a low-melting synthetic polymer component thereof which has a melting point at least 20° C. lower than the melting points of said staple fibers (A) and (B), said low-melting synthetic fibers having a fineness of from 1 to 15 deniers.

2. A wadding material consisting essentially of a mixture of (I) 100 parts by weight of a blend of (1) 90% to 10% by weight of staple fibers (A) selected from natural and synthetic fibers suitable for use in wadding materials, said staple fibers (A) having a monofilament fineness in the range of 3 to 10 deniers and a curliness of not less than 15%, and (2) 10% to 90% by weight of staple fibers (B) made of synthetic polymer suitable for use in wadding materials having a monofilament fineness in the range of 0.7 to 4 deniers and a curliness of less than 15%, the fineness of said staple fibers (B) being less than the fineness of said staple fibers (A), in which the curliness of said staple fibers (A) and (B) is equal to $(B-A)/B\times 100\%$, wherein A is the fiber length under a load of 2 mg/denier and B is the fiber length under a load of 50 mg/denier; and (II) from 1 to 50 parts by weight, per 100 parts by weight of said blend, of a plurality of film elements comprising synthetic polymer films having thicknesses in the range of 5 to 200 μm suitable for use in wadding materials.

3. A wadding material consisting essentially of a mixture of (I) 100 parts by weight of a blend of (1) 90% to 10% by weight of staple fibers (A) selected from natural and synthetic fibers suitable for use in wadding materials, said staple fibers (A) having a monofilament fineness in the range of 3 to 10 deniers and a curliness of not less than 15%, and (2) 10% to 90% by weight of staple fibers (B) made of synthetic polymer suitable for use in wadding materials having a monofilament fineness in the range of 0.7 to 4 deniers and a curliness of less than 15%, the fineness of said staple fibers (B) being less than the fineness of said staple fibers (A), in which the curliness of said staple fibers (A) and (B) is equal to $(B-A)/B\times 100\%$, wherein A is the fiber length under a load of 2 mg/denier and B is the fiber length under a load of 50 mg/denier; (II) from 1 to 50 parts by weight, per 100 parts by weight of said blend, of a plurality of film elements comprising synthetic polymer films having thicknesses in the range of 5 to 200 μm suitable for use in wadding materials; and (III) from 2 to 100 parts by weight, per 100 parts by weight of said blend and said film elements, of low-melting synthetic fibers suitable for use in wadding materials having a low-melting synthetic polymer component thereof which has a melting point at least 20° C. lower than the melting points of said staple fibers (A) and (B) and said film elements, said low-melting synthetic fibers having a fineness of from 1 to 15 deniers.

4. A wadding material as claimed in claim 2, wherein said synthetic polymer films are made from a synthetic polymer selected from the group consisting of polyesters, polypropylenes, polyethylenes, polyamides, polyvinyl chlorides, and polyvinyl alcohols, said films being of rectangular shape and having a length in the range of 1 to 20 cm and a width in the range of 0.01 to 1 cm, the ratio of length to width thereof being at least 10.

5. A wadding material as claimed in claim 4, wherein said films have a length in the range of 2 to 10 cm, a width in the range of 0.02 to 0.5 cm, and said ratio of length to width is at least 15.

6. A wadding material as claimed in claim 4, wherein said synthetic polymer films have a metal vacuum deposited thereon, whereby said films have an infrared reflection coefficient of at least 50%.

7. A wadding material as claimed in claim 6, wherein said metal is aluminum, and the amount of said film elements is in the range of 4 to 20 parts by weight per 100 parts by weight of said blend.

8. A wadding material as claimed in claim 3, wherein said synthetic polymer films are made from a synthetic polymer selected from the group consisting of polyesters, polypropylenes, polyethylenes, polyamides, polyvinyl chlorides, and polyvinyl alcohols, said films being of rectangular shape and having a length in the range of 1 to 20 cm and a width in the range of 0.01 to 1 cm, the ratio of length to width thereof being at least 10.

9. A wadding material as claimed in claim 8, wherein said films have a length in the range of 2 to 10 cm, a width in the range of 0.02 to 0.5 cm, and said ratio of length to width is at least 15.

10. A wadding material as claimed in claim 8, wherein said synthetic polymer films have a metal vacuum deposited thereon, whereby said films have an infrared reflection coefficient of at least 50%.

11. A wadding material as claimed in claim 10, wherein said metal is aluminum, and the amount of said film elements is in the range of 4 to 20 parts by weight, per 100 parts by weight of said blend.

12. A wadding material as claimed in claim 1, wherein said fibrous masses are substantially globular in an uncompressed state.

13. A wadding material as claimed in claim 2, wherein said wadding material is formed as a plurality of fibrous masses of entangled fibers each having a diameter of from 10 to 50 mm and a density of less than 0.03 g/cm$^3$.

14. A wadding material as claimed in claim 3, wherein said wadding material is formed as a plurality of fibrous masses of entangled fibers each having a diameter of from 10 to 50 mm and a density of less than 0.03 g/cm$^3$.

15. A wadding material as claimed in claim 12, wherein the diameter of said fibrous masses is in the range of 20 to 40 mm, and the density thereof is less than 0.02 g/cm$^3$.

16. A wadding material as claimed in claim 13, wherein said fibrous masses are substantially globular, the diameter of said fibrous masses is in the range of 20 to 40 mm, and the density thereof is less than 0.02 g/cm$^3$.

17. A wadding material as claimed in claim 14, wherein said fibrous masses are substantially globular, and the diameter of said fibrous masses is in the range of 20 to 40 mm, and the density thereof is less than 0.02 g/cm$^3$.

18. A wadding material as claimed in claim 1, wherein the fibers of said wadding material have a lubricating agent thereon, such that the static friction coefficient between fibers is less than 0.45.

19. A wadding material as claimed in claim 2, wherein the fibers of said wadding material have a lubricating agent thereon, such that the static friction coefficient between fibers is less than 0.45.

20. A wadding material as claimed in claim 3, wherein the fibers of said wadding material have a lubricating agent thereon, such that the static friction coefficient between fibers is less than 0.45.

21. A wadding material as claimed in claim 18, wherein said lubricating agent comprises a mixture of polyurethane and polyorganosilicon lubricating agents, wherein the weight ratio of polyurethane to polyorganosilicon is in the range of 1:1 to 1:0.01, and said lubricating agent is used in an amount of from 0.2 to 20 wt.% based on the total weight of said wadding materials.

22. A wadding material as claimed in claim 19, wherein said lubricating agent comprises a mixture of polyurethane and polyorganosilicon lubricating agents, wherein the weight ratio of polyurethane to polyorganosilicon is in the range of 1:1 to 1:0.01, and said lubricating agent is used in an amount of from 0.2 to 20 wt.% based on the total weight of said wadding materials.

23. A wadding material as claimed in claim 20, wherein said lubricating agent comprises a mixture of polyurethane and polyorganosilicon lubricating agents, wherein the weight ratio of polyurethane to polyorganosilicon is in the range of 1:1 to 1:0.01, and said lubricating agent is used in an amount of from 0.2 to 20 wt.% based on the total weight of said wadding materials.

24. A wadding material is claimed in claim 1, wherein said low-melting synthetic fibers consist essentially of composite fibers comprising said low-melting synthetic polymer component and a second synthetic polymer component having a melting point at least 20° C. higher than said low-melting component, each of said low-melting polymer component and said second polymer component being made of a polymer selected from the group consisting of polyesters, polyamides, polyacrylonitriles and polyethylenes.

25. A wadding material as claimed in claim 24, wherein said low-melting synthetic fibers are used in an amount of 4 to 30 parts by weight, based on 100 parts by weight of said blend, said low-melting synthetic fibers having a fineness in the range of 1.5 to 10 deniers and a length in the range of 5 to 100 mm.

26. A wadding material as claimed in claim 3, wherein said low-melting synthetic fibers consist essentially of composite fibers comprising said low-melting synthetic polymer component and a second synthetic polymer component having a melting point at least 20° C. higher than said low-melting component, each of said low-melting polymer component and said second polymer component being made of a polymer selected from the group consisting of polyesters, polyamides, polyacrylonitriles and polyethylenes.

27. A wadding material as claimed in claim 26, wherein said low-melting synthetic fibers are used in an amount of 4 to 30 parts by weight, based on 100 parts by weight of said blend and said film elements, said low-melting synthetic fibers having a fineness in the range of 1.5 to 10 deniers and a length in the range of 5 to 100 mm.

28. A wadding material as claimed in claim 1, wherein said staple fibers (A) are hollow and have a hollowness percentage in the range of 5 to 30%.

29. A wadding material as claimed in claim 2, wherein said staple fibers (A) are hollow and have a hollowness percentage in the range of 5 to 30%.

30. A wadding material as claimed in claim 3, wherein said staple fibers (A) are hollow and have a hollowness percentage in the range of 5 to 30%.

31. A wadding material as claimed in claim 1, wherein said staple fibers (A) are selected from the group consisting of fibers of polyesters, polypropylenes, polyethylenes, polyamides, and natural fibers, and said staple fibers (B) are selected from the group consisting of fibers of polyesters, polypropylenes, polyethylenes and polyamides.

32. A wadding material as claimed in claim 2, wherein said staple fibers (A) are selected from the group consisting of fibers of polyesters, polypropylenes, polyethylenes, polyamides, and natural fibers, and said staple fibers (B) are selected from the group consisting of fibers of polyesters, polypropylenes, polyethylenes and polyamides.

33. A wadding material as claimed in claim 3, wherein said staple fibers (A) are selected from the group consisting of fibers of polyesters, polypropylenes, polyethylenes, polyamides, and natural fibers, and said staple fibers (B) are selected from the group consisting of fibers of polyesters, polypropylenes, polyethylenes and polyamides.

34. A wadding material as claimed in claim 1, wherein said blend contains (1) 80% to 20% by weight of said staple fibers (A) made of polyester, said staple fibers (A) having a monofilament fineness in the range of 4 to 7 deniers, a curliness of from 18% to 30%, and a length in the range of 20 to 120 mm, and (2) 20 to 80% by weight of said staple fibers (B) made of polyester, said staple fibers (B) having a monofilament fineness in the range of 1 to 3 deniers, a curliness of less than 15%, and a length in the range of 20 to 200 mm.

35. A wadding material as claimed in claim 2, wherein said blend contains (1) 80% to 20% by weight of said staple fibers (A) made of polyester, said staple fibers (A) having a monofilament fineness in the range of 4 to 7 deniers, a curliness of from 18% to 30%, and a length in the range of 20 to 120 mm, and (2) 20 to 80% by weight of said staple fibers (B) made of polyester, said staple fibers (B) having a monofilament fineness in the range of 1 to 3 deniers, a curliness of less than 15%, and a length in the range of 20 to 200 mm.

36. A wadding material as claimed in claim 3, wherein said blend contains (1) 80% to 20% by weight of said staple fibers (A) made of polyester, said staple fibers (A) having a monofilament fineness in the range of 4 to 7 deniers, a curliness of from 18% to 30%, and a length in the range of 20 to 120 mm, and (2) 20 to 80% by weight of said staple fibers (B) made of polyester, said staple fibers (B) having a monofilament fineness in the range of 1 to 3 deniers, a curliness of less than 15%, and a length in the range of 20 to 200 mm.

* * * * *